US011598610B2

(12) United States Patent
Dentler

(10) Patent No.: US 11,598,610 B2
(45) Date of Patent: Mar. 7, 2023

(54) MOUNTING DEVICE FOR A TELESCOPIC SIGHT ON A HUNTING OR SPORTS WEAPON WITH AT LEAST ONE RESILIENT STAY BOLT

(71) Applicant: Daniel Dentler, Leutkirch (DE)

(72) Inventor: Daniel Dentler, Leutkirch (DE)

( * ) Notice: Subject to any disclaimer, the term of this patent is extended or adjusted under 35 U.S.C. 154(b) by 73 days.

(21) Appl. No.: 17/070,407

(22) Filed: Oct. 14, 2020

(65) Prior Publication Data

US 2021/0108890 A1 Apr. 15, 2021

(30) Foreign Application Priority Data

Oct. 15, 2019 (EP) ..... 19203308

(51) Int. Cl.
*F41G 11/00* (2006.01)

(52) U.S. Cl.
CPC ..... *F41G 11/003* (2013.01)

(58) Field of Classification Search
CPC ..... F41G 11/003
See application file for complete search history.

(56) References Cited

U.S. PATENT DOCUMENTS 1,837,290 A * 12/1931 Redfield ..... F41G 11/006 42/127
2,942,346 A * 6/1960 Staubach ..... F41G 11/007 42/127
3,785,603 A * 1/1974 Apel ..... F41G 11/001 248/222.13
5,035,487 A * 7/1991 Herz ..... F41G 11/001 359/896
5,070,637 A * 12/1991 French ..... F41G 11/007 42/122
5,111,587 A * 5/1992 Plank ..... F41G 11/006 D22/110

(Continued)

FOREIGN PATENT DOCUMENTS

| | | | |
|---|---|---|---|
| DE | 4444677 | C1 | 2/1996 |
| EP | 2615408 | A2 | 7/2013 |
| WO | 2004068058 | A1 | 8/2004 |

*Primary Examiner* — Michelle Clement
(74) *Attorney, Agent, or Firm* — Browdy and Neimark, P.L.L.C.

(57) ABSTRACT

A mounting device for the detachable mounting of a telescopic sight on a weapon consisting of a weapon-side base rail and a telescopic sight-side mounting rail connected thereto via at least one locking element wherein at least one clamping force acting perpendicularly to the surface of the two rails can be generated by actuating the locking element resulting in a positive and non-positive connection between the two rails wherein a clamping shaft of the locking element is held rotatably in the one rail and supports at least one wedge recess which, during rotating actuation of the locking element can be brought into non-positive engagement with a recess of a stay bolt which is arranged on the opposite rail, wherein the locking element during clamping or locking between the weapon-side base rail and the mounting rail mounted positively thereon, additionally generates a displacement force acting in the axial direction (longitudinal direction) of the two rails wherein further the stay bolt is mounted in a spring-loaded manner in a rail-side guide part in an axially displaceable manner.

16 Claims, 7 Drawing Sheets

(56) References Cited

U.S. PATENT DOCUMENTS

Figure 1:
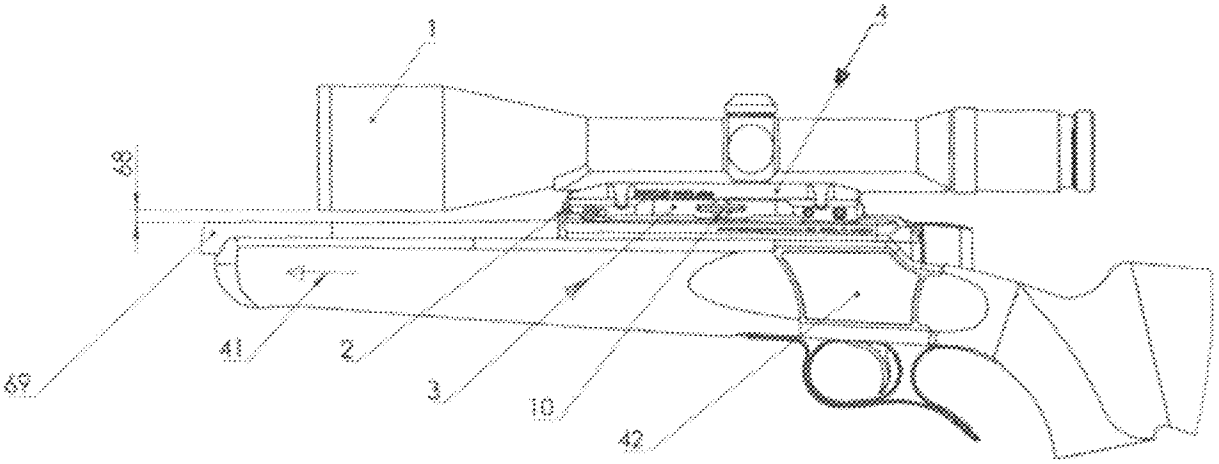

| | | | | | |
|---|---|---|---|---|---|
| 5,390,419 | A * | 2/1995 | Sirkis | F41G 11/006 | 42/127 |
| 6,594,938 | B2 * | 7/2003 | Horton | F41G 11/007 | 42/141 |
| 7,444,776 | B2 * | 11/2008 | Adams | F41G 11/001 | 42/127 |
| 7,543,405 | B1 * | 6/2009 | Ivey | F41G 11/003 | 42/125 |
| 7,971,384 | B2 * | 7/2011 | Lippard | F41G 11/007 | 42/127 |
| 8,136,287 | B2 * | 3/2012 | Adams | F41G 11/001 | 403/325 |
| 8,533,988 | B2 * | 9/2013 | Ziegler | F41G 11/007 | 42/126 |
| 8,533,989 | B2 * | 9/2013 | Ziegler | F41G 11/007 | 42/126 |
| 8,555,542 | B2 * | 10/2013 | Ziegler | F41G 11/007 | 42/126 |
| 8,667,727 | B2 * | 3/2014 | Engelhardt | F41G 11/003 | 42/124 |
| 8,677,673 | B2 * | 3/2014 | Ziegler | F41G 11/001 | 42/124 |
| 11,268,776 | B1 * | 3/2022 | Noonan | F41A 21/28 | |
| 2003/0056417 | A1 * | 3/2003 | Horton | F41G 11/007 | 42/124 |

* cited by examiner 8 (2 : 1)

A-A
10
11
12
13
14
17
18
19
20
22
24
26
28
29
30
32
33
34
36
38
40
42
44
46
48

A-A

B (2 : 1)

MOUNTING DEVICE FOR A TELESCOPIC SIGHT ON A HUNTING OR SPORTS WEAPON WITH AT LEAST ONE RESILIENT STAY BOLT

The invention relates to a mounting device for a telescopic sight for a hunting or sports weapon, wherein such a mounting device is already known from EP 2 615 408 B1 of the same applicant.

The present invention is a further development of the construction of the mounting device in the cited EP 2 615 408 B1 in a special way, and therefore, in the drawings of the present description of the invention, the functionally identical parts of the present mounting device have been given the same reference numerals as were used in EP 2 615 408 B1. In addition, reference is made to the disclosure of this document, which represents the basic principle of a mounting device for a telescopic sight.

Accordingly, all the same parts in the description of the drawing that follows have the same function as already described in EP 2 615 408 B1.

The known mounting device mentioned is characterized in that a firearm-side attachment arrangement with a base rail and a telescopic sight-side mounting rail connected thereto via at least one locking element is present, wherein at least one clamping force acting perpendicular to the surface of the two rails can be generated by actuating the locking element, and preferably there is a positive connection of two spaced-apart spring tabs between the two rails, wherein the locking element is held rotatably in the one rail which is connected to a clamping shaft which supports at least one wedge recess, wherein the clamping shaft, upon rotation of the locking element, can be brought in non-positive engagement with an assigned annular groove-shaped recess of a stay bolt which is attached to the opposite rail, wherein the locking element, during clamping or locking between the weapon-side base rail and the mounting rail mounted positively thereon, additionally generates a displacement force acting in the axial direction (longitudinal direction) of the two rails, preferably resulting in a positive bearing of the stops in the area of the spring tabs.

The above-mentioned construction according to EP 2 615 408 B1 has proven itself to a large extent. It resulted in an easily operated attachment between a weapon-side base rail and a mounting rail connected to the telescopic sight because the two rails could be positively connected to each other with a single-handed rotary actuation of the locking element, and any play between the parts was excluded in any case. By push/pull movement between the rails during mounting, the shear and compressive forces occurring during firing could be absorbed in a favorable manner by the mounting device so that this mounting device has prevailed in multiple productions in the market.

Tests with such a mounting device have shown that improvements are still possible because—inter alia—the stay bolt provided with the reference numeral 12 in EP 2 615 408 B1 can be improved.

In EP 2 615 408 B1, the stay bolt was formed as a threaded bolt at its bolt-side end which could be more or less screwed into an assigned tapped hole in the mounting rail.

Thus, prior to joining the two rails, the height of the stay bolt above the longitudinal groove of the mounting rail could be adjusted first by rotating the stay bolt, which could be more or less screwed into its threaded recess in the tapped hole of the mounting rail due to the rotation.

In order to enable a repeatable screw-in depth of the stay bolt in the mounting rail-side tapped hole, EP 2 615 408 B1 shows a scale on the top of the stay bolt which could be rotated by different degrees according to the scale in order to determine its screw-in depth which also keeps the torque of the clamping or locking always the same.

Tests have shown that a significant optimization of this known mounting device would be possible if the tapped hole on the mounting rail side was dispensed with, which also requires a certain minimum axial length in order to prevent the thread-side external thread of the stay bolt from tearing out of the mounting rail-side receiving hole.

A certain minimum guide length in the receiving hole was also necessary in order to prevent the threaded end of the stay bolt from tilting in this receiving hole. This was, however, associated with the disadvantage that the telescopic sight-side mounting rail had to have a certain minimum height in order to provide the receiving hole for the threaded end of the stay bolt with a minimum axial length protecting against tearing and tilting.

The use of a threaded screw connection between the stay bolt and the telescopic sight-side mounting rail had the further disadvantage that there was an unavoidable axial play in the area of the tapped hole.

The screw-in depth of the stay bolt was also used to compensate for manufacturing inaccuracies in order to achieve a certain repeatable distance between the telescopic sight-side mounting rail and the weapon-side base rail.

By setting the screw-in depth of the stay bolt into the telescopic sight-side mounting rail once, it was achieved that manufacturing tolerances in the bearing surfaces between the weapon-side base rail and the telescopic sight-side mounting rail were compensated.

The invention is based on the object of developing further a mounting device of the type mentioned at the beginning according to EP 2 615 408 B1 in such a way that a telescopic sight-side mounting rail with a significantly reduced overall height can be used and that manual adjustability of a stay bolt is no longer necessary.

To solve the problem, the invention is characterized by the technical teaching in an embodiment of a mounting device for the detachable mounting of a telescopic sight on a weapon consisting of a weapon-side base rail and a telescopic sight-side mounting rail connected thereto via at least one locking element, wherein at least one clamping force acting perpendicularly to the surface of the two rails can be generated by actuating the locking element resulting in a positive and non-positive connection between the two rails, wherein a clamping shaft of the locking element is held rotatably in the one rail and supports at least one wedge recess which, during rotating actuation of the locking element, can be brought into non-positive engagement with a recess of a stay bolt which is arranged on the opposite rail, wherein the locking element, during clamping or locking between the weapon-side base rail and the mounting rail mounted positively thereon, additionally generates a displacement force acting in the axial direction (longitudinal direction) of the two rails, characterized in that the stay bolt is mounted in a spring-loaded manner in a rail-side guide part in an axially displaceable manner.

Therefore, in an advantageous embodiment, a mounting device for a telescopic sight for a hunting or sports weapon is proposed in which the connection between the mutually parallel rails to be connected in a positive manner is formed by at least one axial stay bolt which is arranged at the one rail and which is in engagement with a clamping shaft cooperating with the stay bolt which clamping shaft is rotatably mounted on the other rail.

In a first advantageous embodiment, the stay bolt in its axial longitudinal extension is mounted axially displaceable and secured against tilting in a spring-loaded manner in a mounting rail-side guide part. The at least one axially spring-preloaded stay bolt thereby forms the at least one spring-preloaded connection between the rails assigned to one another. A threaded stay bolt, as is known from EP 2 615 408 B1, is omitted. Instead of the known threaded screw connection, at least one spring-preloaded stay bolt is provided.

In a second advantageous embodiment, the kinematic reversal of the first embodiment is provided. In this case, the spring-preloaded displacement bearing of the stay bolt is dispensed with. Rather, said stay bolt is then attached non-displaceable on one rail part. The spring preload on the stay bolt is instead achieved by a resilient mounting of the clamping shaft. In this case, the two bearing ends of the clamping shaft are held in springs so that the clamping shaft is resiliently preloaded in the axial direction of the longitudinal extension of the stay bolt. Whenever the advantages and features of the first embodiment are described in the following description, this also applies analogously to the second embodiment.

With both embodiments there is the advantage that a threaded screw connection between a stay bolt and the mounting rail-side mounting rail is dispensed with and instead a floating, axially displaceable, resilient guide for the stay bolt is provided in an assigned receiving hole.

This has the advantage that due to the fact that a threaded screw connection between the stay bolt and the telescopic sight-side mounting rail is dispensed with, now fine adjustment of the screw-in depth of the stay bolt is no longer necessary because it is—in the first embodiment—resiliently mounted in the axial direction and thus bears against the clamping shaft of the locking element with a previously set spring force. The stay bolt is non-positively connected to the locking element against this spring force resulting in an axial displacement force acting between the two rails in the same way as in EP 2 615 408 B1. Accordingly, additionally, a displacement force acting in the axial direction of the two rails is generated in clamping or locking the weapon-side base rail and the mounting rail held on it in a positive manner resulting in, for example, a positive bearing of stops in the area of a front spring plate.

Because of the resilient displacement mounting of the stay bolt—as stated—a fine thread adjustment is dispensed with, and the correct amount is always given, because, due to the spring force, the two rails assigned to one another are always attracted to each other with the same force and this force is effected by the spring force on the stay bolt.

In a preferred embodiment of the invention it is provided that the spring mounting of the stay bolt occurs due to a disc spring or due to a disc spring assembly.

In other configurations, an elastomer spring, a helical compression spring or other energy storage devices can also be used instead of a disc spring.

In another embodiment, it can also be provided that the spring force on the stay bolt, which acts on the stay bolt in the axial direction, is exerted by hydraulic or pneumatic preloading.

A feature of all embodiments is that the two rails are attracted to each other with a set spring force, and this also compensates for manufacturing tolerances that had to be compensated for in the prior art by fine adjustment of the screw-in depth of the stay bolt, which can be omitted according to the present invention.

As described in EP 2 615 408 B1 of the applicant, the mutual assignment of the terms of weapon-side base rail and telescopic sight-side mounting rail is not important. The parts mentioned can also be mounted in a kinematic reversal so that, for example, the telescopic sight-side mounting rail is mounted on the weapon, and the weapon-side base rail is mounted on the telescopic sight. This was already the subject of EP 2 615 408 B1 and shall also apply to the present invention. The terms "(weapon-side) base rail" and "(telescopic sight-side) mounting rail" can therefore be used interchangeably throughout the text of this description of the invention.

Furthermore, the invention is not limited to the fact that a single stay bolt with the new features according to the invention is used. In another embodiment, it can be provided that two spaced-apart stay bolts are arranged on one of the rails, each of the stay bolts being spring-preloaded in the axial direction, as described above.

In a preferred embodiment of the invention, it is also provided that the stay bolt is formed as a locking bolt, which means that it can be inserted into a locking opening in the area of the telescopic sight-side mounting rail and rotated by 90° with a tool, whereby it is drawn into the attachment recess via the thereby preloaded disc spring and is fixed there.

It is therefore a bayonet-like fixing of the stay bolt in an assigned recess in the area of the telescopic sight-side mounting rail, and according to a further, preferred feature it is provided that, after the fixing of the stay bolt with its edge-side opposite key surfaces, it is provided that said stay bolt is locked in a rotatably fixed manner in its final mounting position.

Such a rotatably fixed locking can be done, for example, by a spring-loaded locking ball, which fixes the stay bolt in its end position and secures it against further rotation.

Thus, it is a rotational position of the stay bolt that is secured against rotation in a bearing pocket in the area of the telescopic sight-side mounting rail.

According to a further feature of the invention, it is provided that an insertion pocket is present in the telescopic sight-side mounting rail for mounting the disc spring, which insertion pocket is also referred to as the mounting pocket in the subsequent description.

The insertion pocket is a lateral extension of the bearing pocket provided for the disc spring, so that it is possible, using the mounting pocket, to insert the disk spring into the mounting pocket and move it in the axial direction until it falls into the assigned bearing pocket for the stay bolt. Then, the stay bolt is placed on the disc spring. In this case, the bolt-side end of the stay bolt engages through a central recess in the disc spring and bears against a guide part which is formed as an elongate sleeve that is open on one side which, in a preferred embodiment, is connected to the underside of the telescopic sight-side mounting rail materially in one piece. In an embodiment that is different from this one, the guide part can also be detachably attached to the mounting rail.

Due to the arrangement of a guide part which is extended in the axial direction and which has a guide projection which is directed in the axial direction and at which an angled end projection is arranged in the horizontal direction, it is achieved that the stay bolt finds a rotary guide practically over its entire axial length because it bears against bearing surfaces in the area of the axial guide projection of the guide part with its outer circumference and is rotatably mounted there in a load-transmitting manner.

It is therefore an external guide between the guide part, which is connected to the mounting rail, and the stay bolt, which is rotatably mounted in the guide part, but can be displaced in it under spring load.

Instead of the arrangement of such a guide part, which bears positively against the outer circumference of the stay bolt with its inner circumference, other guide constructions can also be used.

In a further development of the invention, it can be provided that the guide part is replaced by an axle which is present on the angled end projection of the sleeve-like guide part and which engages in an assigned receiving hole in the end face at the bolt-side end of the stay bolt and is mounted there displaceably. With this different type of mounting, the stay bolt is guided on the pin-like cylinder projection and at the same time can be displaced in a spring-loaded manner on the guide projection.

Another advantage of the reduced structural height of the telescopic sight-side mounting rail, which is due to the fact that the threaded screw connection between the stay bolt and the mounting rail is dispensed with, is that the spring plates that were previously formed from multiple parts and that were used as separate elements in the rails—as described in EP 2 615 408 B1—can now be omitted, and these spring plates can now be molded directly materially in one piece to the telescopic sight-side mounting rail.

This results in significant weight saving and a reduction in the number of components.

The subject matter of the present invention results not only from the subject matter of the individual claims, but also from the combination of the individual patent claims with one another.

All information and features disclosed in the documents, including the abstract, in particular the spatial configuration shown in the drawings, could be claimed as being essential to the invention, insofar as they are novel, individually or in combination, compared to the prior art. The use of the terms "substantially" or "according to the invention" or "essential to the invention" is subjective and does not imply that the features named in this way must necessarily be part of one or more claims.

In the following, the invention is explained in more detail with reference to drawings showing only one route of execution. Further features and advantages of the invention that are essential to the invention emerge from the drawings and their description.

FIG. 1: shows a side view of a telescopic sight detachably attached to a weapon via the mounting device.

Figure 2:
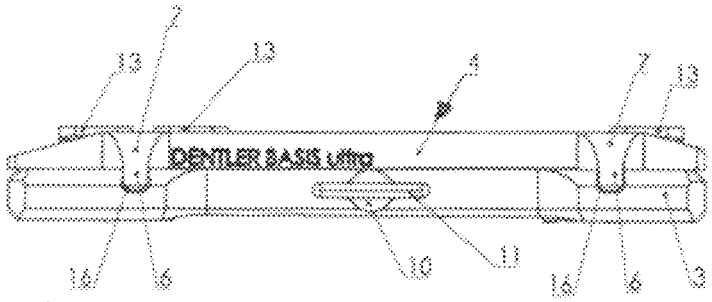
Figure 3:
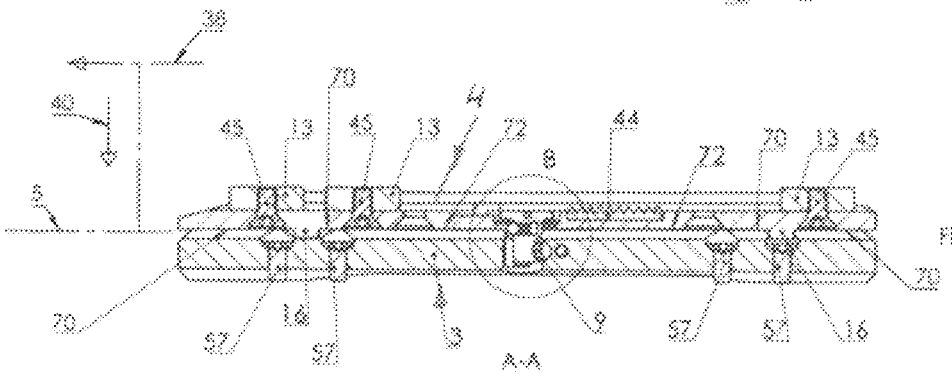
Figure 4:
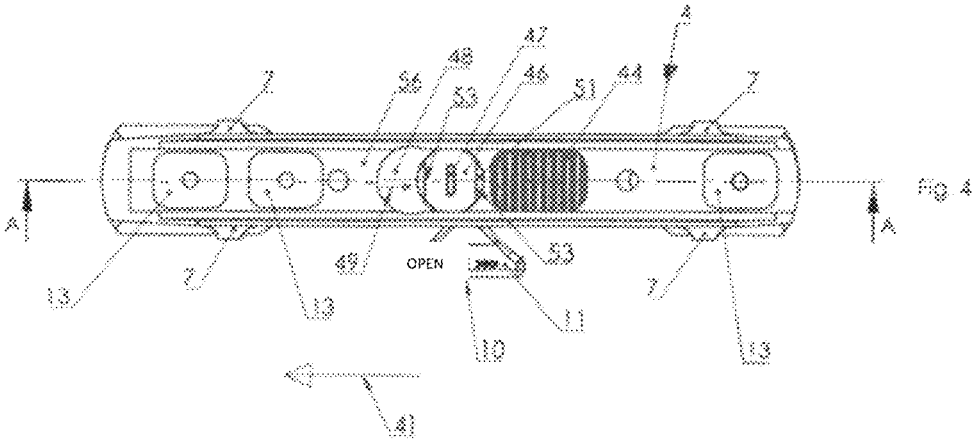

FIG. 2: shows a side view of the mounting device, consisting of a weapon-side base rail and a telescopic sight-side mounting rail FIG. 3: shows a longitudinal section through the arrangement according to the line A-A in FIG. 4

Figure 5:
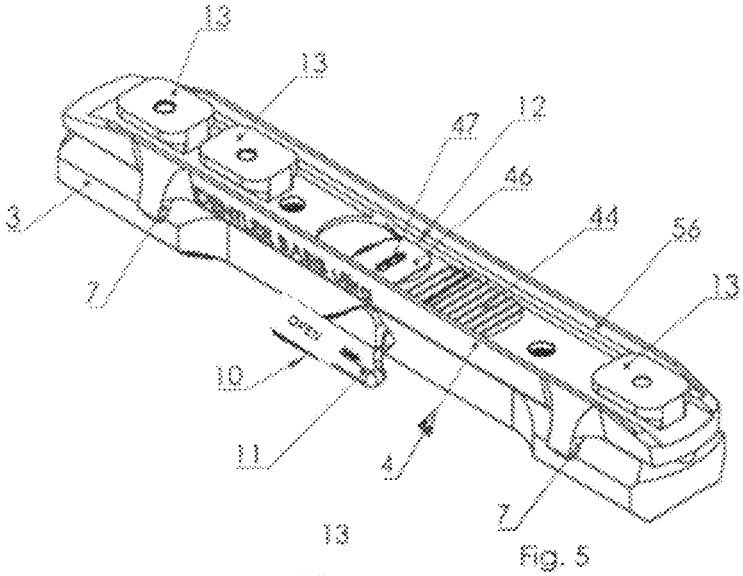

FIG. 4: shows a plan view of the telescopic sight-side mounting rail with the telescopic sight removed FIG. 5: shows a perspective representation of the combined mounting device according to FIGS. 2 to 4

Figure 6:
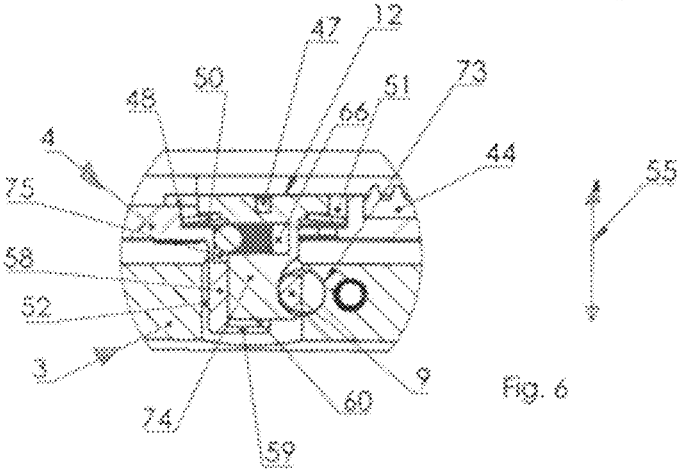
Figures 4A, 4B, 4C:
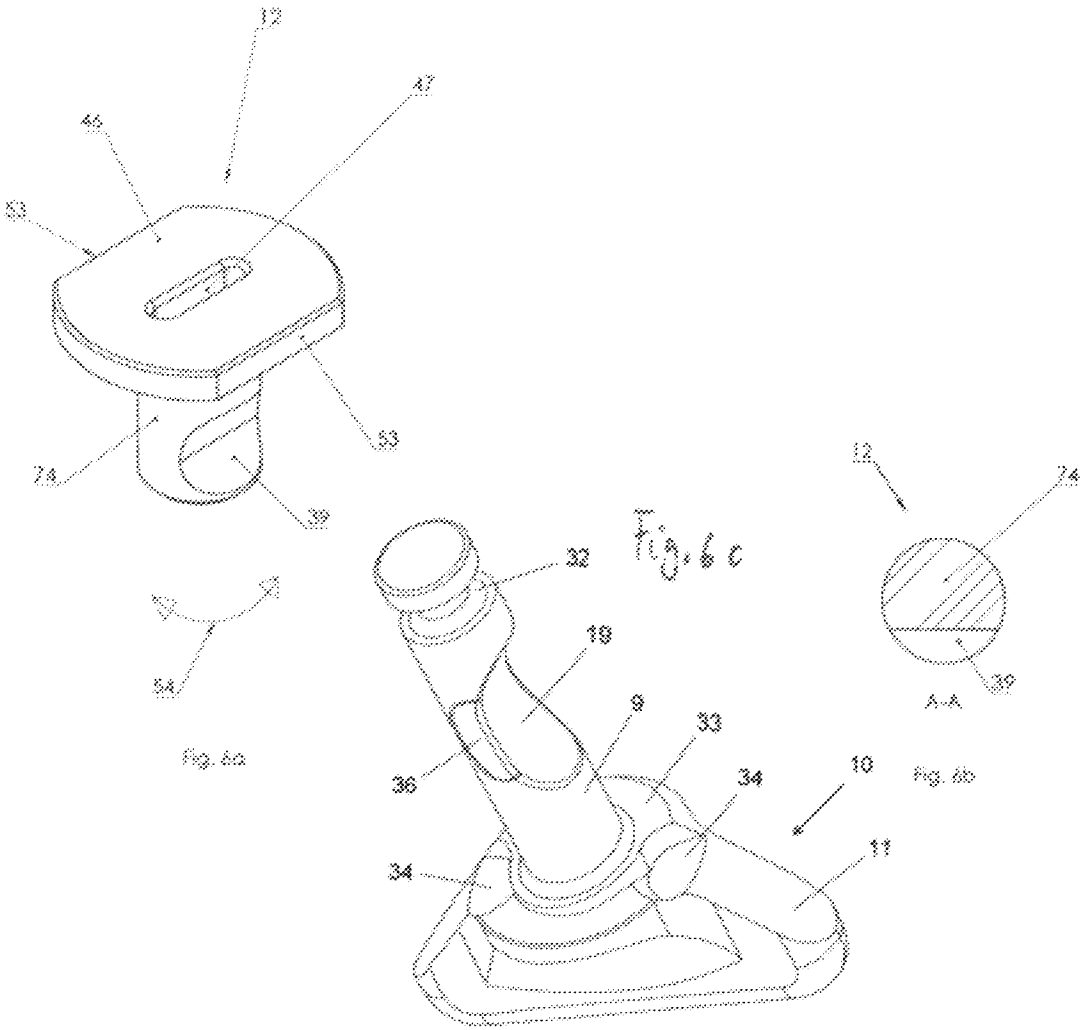
Figure 7:
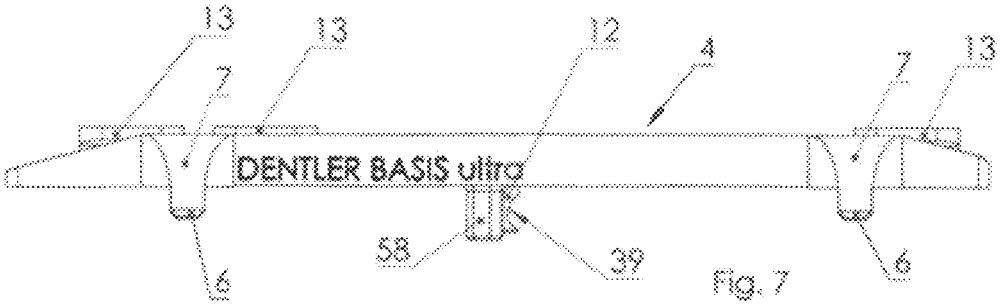
Figure 8:
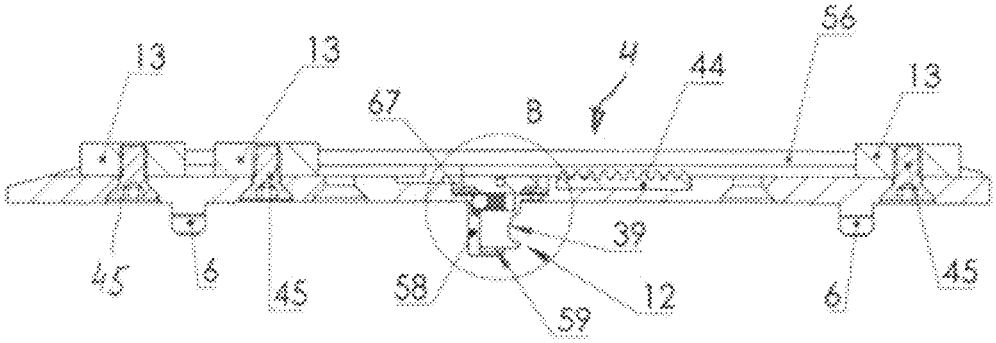
Figure 9:
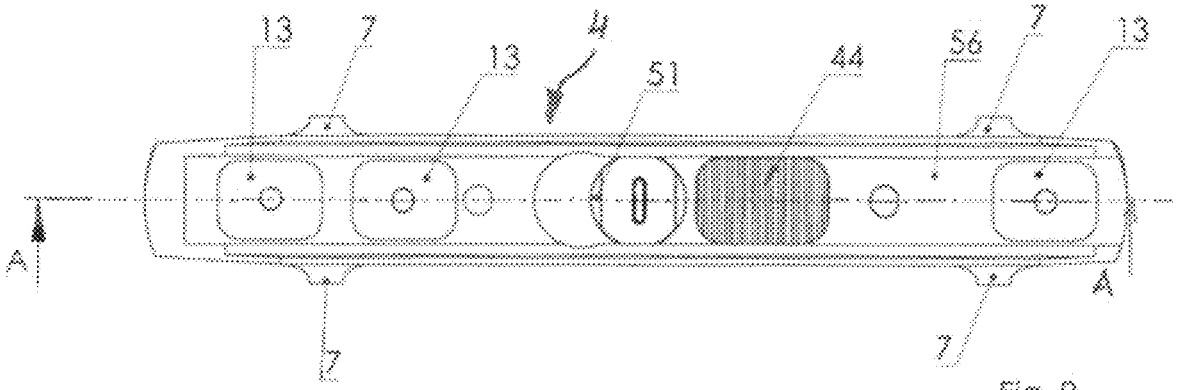

FIG. 6: shows a detail A-A according to FIG. 3 with a representation of the spring-loaded stay bolt FIG. 6*a*: shows a perspective representation of the stay bolt FIG. 6*b*: shows a plan view or a section of the bolt end of the stay bolt FIG. 6*c*: shows perspective representation of the locking element FIG. 7: shows the side view of the telescopic sight-side mounting rail FIG. 8: shows the section through the telescopic sight-side mounting rail according to the line A-A in FIG. 9

Figure 10:
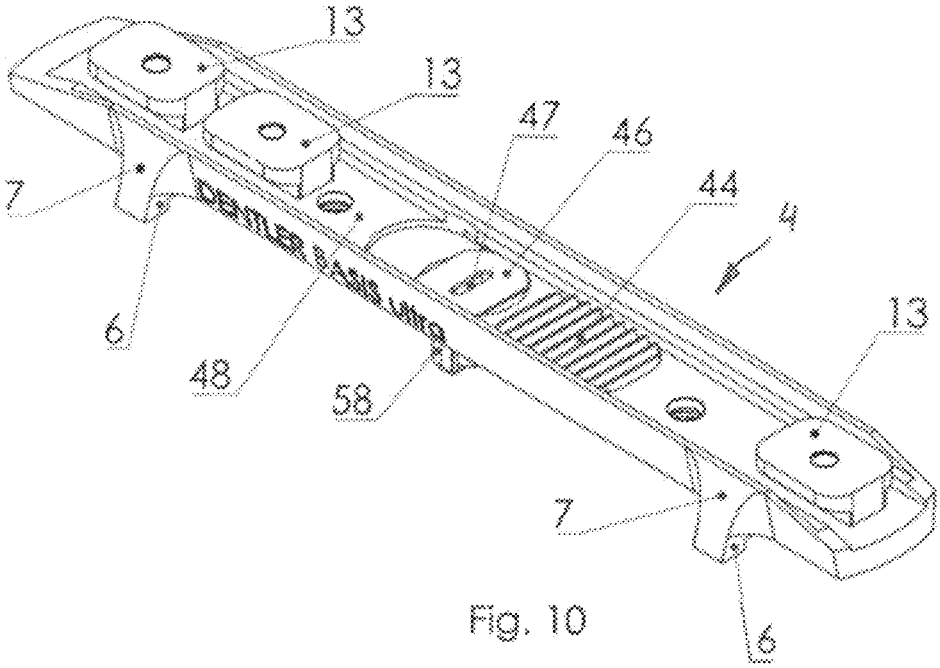
Figure 11:
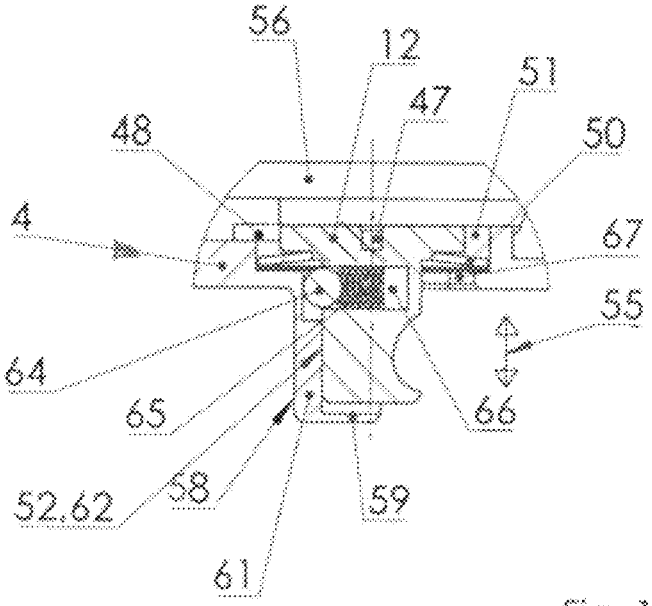
Figure 12:
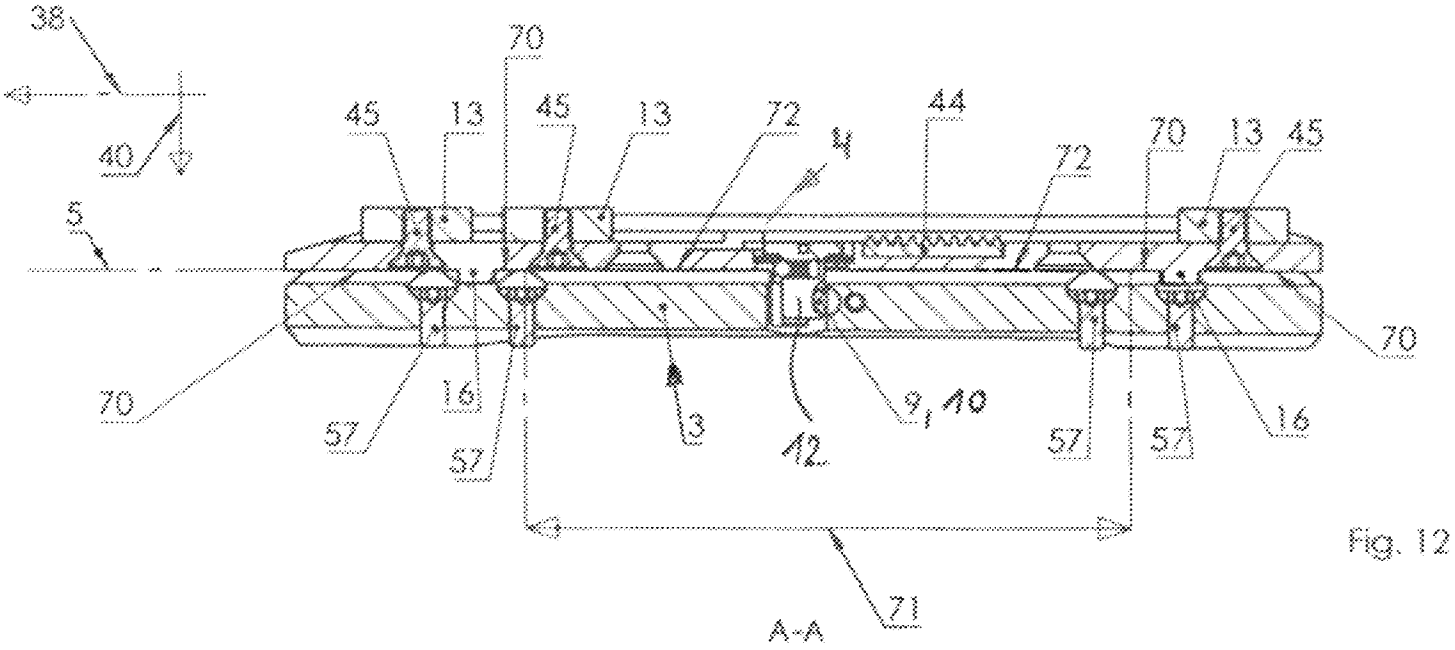

FIG. 9: shows the plan view of the telescopic sight-side mounting rail, similar to a representation in FIG. 4, but with the base rail removed FIG. 10: shows the perspective representation of the telescopic sight-side mounting rail FIG. 11: shows the detail A-A corresponding to FIG. 8 with an enlarged representation of the stay bolt FIG. 12: shows a schematic representation of the multi-point support between the weapon-side base rail and the telescopic sight-side mounting rail Before addressing the individual terms in the drawings, it is noted that—just like in EP 2 615 408 B—the designation of the weapon-side basic rail 3 and the designation of the telescopic sight-side mounting rail 4 can be interchanged. It can be provided in another embodiment, not shown in detail, that the weapon-side base rail 3 is mounted on the telescopic sight and thus represents the telescopic sight-side rail, while conversely the telescopic sight-side mounting rail 4 shown here can now be connected to the weapon in order to represent the weapon-side base rail.

Merely for the sake of simplicity, it is assumed in the following description that the weapon-side base rail 3 is connected to the weapon 42 and the telescopic sight-side mounting rail 4 is connected to the telescopic sight 1. However, as described above, this can also be done the other way around in a kinematic reversal.

Because of the further function of the individual parts, reference is made to the description of the invention in EP 2 615 408 B1, which is intended to be fully comprised by the subject matter of the present invention.

FIG. 1 shows that a weapon-side base rail 3 is attached to the top of the weapon 42 with attachment means (not shown in detail) and the mounting device 2 now consists of the weapon-side base rail 3 and the telescopic sight-side mounting rail 4 detachably connected to it.

On the mounting rail 4, the telescopic sight 1 is screwed to certain attachment elements which will be shown later.

An advantage of the invention lies in the fact that the structural height of the telescopic sight-side mounting rail 4 is now reduced substantially, as represented by the distance 68 in FIG. 1.

In the prior art according to EP 2 615 408 B1, the distance 68 was 50% higher, which was associated with the required greater structural height of the telescopic sight-side mounting rail 4.

This is the advantage of the invention, which now achieves a 50% reduced distance 68 between the weapon barrel 69 and the telescopic sight 1.

By reducing this distance 68, the ballistics is less impacted when a shot is fired, which means that the sighting axis through the telescopic sight 1 compared to the weapon axis through the weapon barrel 59 are now closer together. The barrel bore axis is therefore situated closer to the optical axis, which is associated with great advantages when assembling the telescopic sight and when firing a shot.

For the sake of clarity, the firing direction 41 is also shown with the arrow direction 41.

FIGS. 2 to 6 show the assembled state of the mounting device 2, which means that the two mutually associated rails 3, 4 are load-transmitting firmly and positively connected to each other, using a locking element 10, which substantially consists of a handle 11, which is non-rotatably connected to a rotatably mounted clamping shaft 9.

The two rails 3, 4 are connected to each other in the area of a parting plane 5, and—as described in the prior art— upon actuation of the locking element 10, resulting in a displacement of the telescopic sight-side mounting rail 4 in the axial direction (arrow direction 38) and simultaneously in a displacement perpendicular thereto in the arrow direction 40.

Both displacements in the arrow directions 38, 40 lead to the positive fixing of spaced-apart spring bars 7 which are connected materially in one piece to the sides of the mounting rail 4, wherein at their respective free ends spring tabs 6 are molded which are beveled in order to achieve a positive, displacement-free bearing against the opposite rail.

For this purpose, the spring tabs 6 engage in assigned receiving grooves 16 in the area of the base rail 3 and are mounted there positively.

Accordingly, the full force between the weapon-side base rail 3 and the telescopic sight-side mounting rail 4 is transmitted via the spring tabs 7 and the spring tabs 6 molded thereto to the base rail-side receiving grooves 16.

Furthermore, FIGS. 2 to 4 also show to some extent the attachment of the telescopic sight, because it is shown that so-called slot nuts 13 are fixed to the mounting rail 4 with the aid of attachment screws 45, with at least one toothed rail 44 being arranged in the longitudinal groove 56 of the mounting rail 4, which is brought into engagement with a toothed rail (not shown) on the underside of the telescopic sight so as to be secured against displacement.

The groove nuts 13 each engage in an assigned telescopic sight-side undercut groove receptacle on the on the telescopic sight 1.

The invention is not limited to the attachment of the telescopic sight 1 shown here on the telescopic sight-side mounting rail 4 in the area of its longitudinal groove 56. A ring mounting with clamping rings can also be provided, as shown in the subject matter of EP 2 615 408 B1. All other positive connections that are also detachable are also possible.

There are a total of four sequential bearing surfaces 70 in the longitudinal direction between the mutually assigned rails 3, 4, as shown in FIG. 3 and in FIG. 12.

Accordingly, the bearing surfaces 70 are situated in the parting plane 5 between the rails 3, 4 assigned to one another and are spaced apart 71 from one another, as shown in FIG. 12.

The respective spring bar 7 engages in the space between the adjacent bearing surfaces 70 and thus forms the load-transmitting connection between the two rails 3, 4.

As a result of the spaced-apart 71 bearing surfaces 70, which are spaced apart from each other in the axial direction, there is a release 72 in the intermediate area, in the area of which the locking element 10 is arranged with the stay bolt 12 that is resiliently displaceable in the axial direction. This is also shown, inter alia, in FIG. 12.

This results in the advantage that due to the arrangement of the locking element 10 in the area of this release 72, the spring force of the stay bolt acts on the free underside of the mounting rail 4 and thereby achieving a particularly favorable contact force or transmission force on the mounting rail 4.

With a relatively low spring force of a disc spring 50, a large-area fixing of the mounting rail 4 on the weapon-side base rail 3 can thus be achieved.

FIG. 3 also shows that the weapon-side base rail 3 is attached to the top of the weapon with the aid of attachment screws 57.

There are, of course, other attachment options also, such as, for example, clamping levers, eccentric levers, push-on or wedge attachments.

According to FIGS. 6*a* and 6*b*, the stay bolt 12 consists substantially of an upper, plate-shaped closing plate 46, in the area of which an actuating slot 47 is arranged for the engagement of a tool.

The stay bolt 12 is initially rotatably and lockably mounted with its closing plate 46 in an assigned bearing pocket 51 in the area of the longitudinal groove 56 of the mounting rail 4. Details can be found in FIGS. 6, 6*a* and 6*b*.

According to FIG. 6*a*, a bolt end 74 is materially in one piece molded to the stay bolt 12 at the underside of the closing plate 46, and the lower end face of the bolt end 74 has a certain axial distance to a guide recess 60 according to FIG. 6, which is formed in the guide part 58 which is preferably connected materially in one piece to the telescopic sight-side mounting rail 4.

This guide part 58 is formed as a sleeve open on one side, the open surface of which points against the firing direction 41.

In this way, an axial displacement guide secured against tilting and canting is achieved for the bolt end 74 of the stay bolt 12.

The axial distance in the area of the guide recess 60 of the guide part 58 in connection with the angled end projection 59 of the guide part (see FIG. 11) allows an axial movement play of the stay bolt 12 in the guide part 58.

Said stay bolt 12 can therefore move spring-loaded, spring-loaded under the action of the disc spring 50, and secured against tilting, in the axial direction in the area of the guide part 58.

For the mounting of the disc spring 50, the bearing pocket 51 in the longitudinal groove 56 of the mounting rail 4 is enlarged by a mounting pocket 48 having the same radius and longitudinally elongated in the axial direction. The two parts that merge into one another and are connected to one another, namely the bearing pocket 51 and the mounting pocket 48, indeed merge into one another, but are separated from one another in terms of height by a shoulder.

This has the advantage that, for mounting the disc spring 50, said disc spring 50 is inserted into the mounting pocket 48 and then displaced in the arrow direction 49 in order to drop into the recessed bearing pocket 51 for mounting the stay bolt 12.

The stay bolt end 74 is then pushed through the disc spring 50 and the underside of the closing plate 46 comes to bear against the disc spring, which is now situated in the area of the bearing pocket 51.

For the bayonet-like locking of the stay bolt 12 by rotating the locking plate 46 by 90°, it is provided that there are opposing key surfaces 53 on the outer circumference of the locking plate 46 which surfaces enable the stay bolt 12 to be inserted into the bearing pocket 51 and which, with the correctly assembled rotation of the closing plate 46, engage in undercuts in the area of the bearing pocket 51, so that, in case of a correctly assembled fixing of the stay bolt 12, the closing plate 46 prevents that the stay bolt 12 is pushed upward out of the bearing pocket 51.

A spring-loaded rotary lock, which is shown in more detail in FIG. 6, is provided for locking the correctly assembled rotational position of the stay bolt 12. It is a transverse hole 66 in the bolt end 74 of the stay bolt 12, in which a compression spring 65 is mounted, on which a locking ball 64 acts, which engages in an assigned locking recess 75 in the manner of a spring-loaded index ball and secures the stay bolt 12 against rotating out of its correct rotational position.

Instead of a rotary lock of the rotating bolt with a spring-loaded locking ball, other rotational locks can of course also be used, such as, for example, a key or a threaded guide pin which engages in an assigned recess in the stay bolt and secures it against rotation.

In the embodiment according to FIGS. 6, 6*a*, 6*b*, it is advantageous if the disc spring 50 or a disc spring assembly now engages beneath the stay bolt, which is held non-rotatably in its displacement position, and due to this special arrangement, the locking element 10 can be used to provide the desired displacement in the arrow directions 38, 40.

For this purpose, the bolt end 74 of the stay bolt 12 is a hollow recess 39, which in the prior art (EP 2 615 408 B1) is formed as an annular groove.

Another feature of the invention is that instead of an annular groove which overall weakens the cross-section of such a stay bolt, a single-sided hollow recess 39 is provided, which is associated with the advantage that the round material cross-section of the bolt end 74 is only slightly weakened by the single-sided hollow recess 39 according to FIG. 6*b*. This means that the stay bolt 12 can also transmit higher loads than in the prior art. According to FIG. 6, the hollow recess 39 is shaped as a circular section area and, according to FIG. 6*a*, consists of two angularly intersecting surfaces, so that the hollow recess 39 forms a circular recess at an angle in the transverse direction to the longitudinal extension of the bolt end 74.

The stay bolt 12, with its bolt end 74 (see FIG. 6*b*), which is not weakened in cross section, forms an enlarged bearing surface (see FIG. 11) of this bolt end 74 at the guide part 58, as shown in FIG. 11.

Accordingly, the stay bolt 12 is guided over a greater axial length in the direction of displacement, which is associated with increased stability against tilting, as could not be achieved with threaded screw connections according to the prior art.

According to FIG. 6*b*, a further advantage results from the fact that the hollow recess 39, which is open on one side, provides an enlarged load-transmitting surface for the engagement of the clamping shaft 9.

A locking element 10 with a clamping shaft 9 molded thereon can be seen in FIG. 6*c*. The hollow recess 39 of the stay bolt 12 engages in the wedge recess 19 of the clamping shaft 9 in a non-positive and positive manner. The wedge recess 19 is followed by a release, so that a first clamping action is effected during the rotation of the clamping shaft 9 by the engagement thereof into the release 36 in the wedge-shaped and eccentric hollow recess 39 at the bolt end 74 of the stay bolt 12. With increasing further rotation of the clamping shaft 9, the release 36 transitions into the wedge recess 19, via which the preliminary clamping force is then increased many times over in order to achieve the final clamping force. The bolt end 74 of the stay bolt 12 is preloaded with great force against the spring force of the disc spring 50 in the direction of its longitudinal extension.

It is advantageous if the clamping shaft 9 is situated in a clamping shaft hole 73 which is formed eccentrically in relation to the center axis of the hollow recess 39. This is shown in FIG. 6.

Upon rotation of the clamping shaft 9 in the counterclockwise direction according to FIG. 6, the stay bolt 12 is thus pulled down in the arrow direction 55 against the force of the disc spring 50, wherein the displacement path 63 in the area of the guide recess 60 can be exploited.

As previously shown, the guide part 58 has an axially extending, sleeve-like guide projection 61 that is open on one side, on the inside of which the bearing surface 62 is arranged for bearing against the outer circumference of the bolt end 74 of the stay bolt 12.

An elongated hole 67 is arranged in the body of the mounting rail 4, which hole enables the locking ball 64 and the compression spring 65 to be mounted.

The elongated hole 67 is an extension of the hole. FIG. 6 shows that a bearing hole 52 is arranged in the mounting rail 4 as an extension of the guide part 58, in which bearing hole 52 the stay bolt 12 is rotatably and spring-loaded displaceably mounted. The stay bolt is only rotated during mounting. After mounting is complete, the stay bolt is secured against rotation by the spring-loaded locking ball 64 and can be displaced in a spring-loaded manner only in the axial direction of its bolt end 74.

Thus, the present invention has the advantage that with a greatly reduced structural height of the one rail 4, a special type of attachment of a stay bolt 12 is now provided, which is no longer formed as a threaded screw connection, but as a spring-loaded bayonet screw connection, which represents a significant advantage compared to the prior art.

The illustrated spring-loaded bayonet connection represents a particularly elegant mounting of the stay bolt 12 because said stay bolt 12 engages assigned undercuts in the area of the mounting rail by means of its closing plate 46 and after mounting is complete, said stay bolt is secured against rotation and can be displaced in a spring-loaded manner only in the axial direction (in the direction of its longitudinal extension).

In another embodiment, not illustrated graphically, it can be provided that, instead of a bayonet screw connection for the securing of the axial position of the stay bolt 12, a simple attachment plate is present that is arranged on the mounting rail side and rotatable on one side and which covers, in the working position, the head of the stay bolt upwardly in the bearing pocket 51 and which is attached with the aid of an attachment screw on the mounting rail and is rotatable parallel to the surface of the mounting rail 4. In the mounting position, the attachment plate is pivoted away from the bearing pocket 51 so that the stay bolt can be introduced into the bearing pocket 52. In the working position, the attachment plate is pivoted over the bearing pocket 51 and covers the head of the stay bolt 12, namely its closing plate 46, towards the top. This type of attachment also secures the stay bolt 12 from falling out of the guide part 58 upwards.

With this solution, the rotate and screw attachment of the stay bolt 12 is omitted. Rather, the stay bolt is directly inserted in the bearing hole 52 in the direction of its longitudinal extension and fixed with the aid of the pivotable attachment plate situated above.

In principle, the bayonet screw connection can also be completely omitted, so that the stay bolt 12 is only inserted into the bearing hole 52 on the guide part 58 in the direction of its longitudinal extension and the previously described rotary lock would then also provide an axial displacement lock for the stay bolt 12. There is therefore no need for a bayonet screw connection to secure against falling out and also no rotatably mounted attachment plate.

The mounted telescopic sight 1 then secures the stay bolt 12 with its underside against falling out in the direction of its longitudinal extension upwards, because suitable bearing surfaces are provided on the underside of the telescopic sight.

A groove and spring guide or a dovetail guide arranged in the longitudinal direction of the stay bolt 12 at or in the bearing pocket 51 and/or the guide part 58 can be provided for the stay bolt 12 in the bearing pocket 51 and/or in the guide part 58 as a longitudinal guide secured against rotation.

The invention is therefore not dependent on a bayonet screw connection of the stay bolt to secure it against falling out, but prefers such a configuration because it is a particularly elegant and simple attachment of such a stay bolt 12.

REFERENCE NUMERALS

1 telescopic sight
2 mounting device
3 base rail (weapon)
4 mounting rail (2F)
5 parting plane
6 spring tabs
7 spring bar
8
9 clamping shaft
10 locking element
11 handle
12 stay bolt
13 slot nut
14
15
16 receiving groove (in 3)
17
18
19 wedge recess (of 9)
20.
21
22
23
24
25
26
27
28
29
30
31
32 annular groove (of 9)
33 head (of 9)
34 receiving hole (of 9)
35
36 release (of 9)
37
38 arrow direction (pushing direction)
39 hollow recess (eccentric)
40 arrow direction (pushing direction)
41 firing direction
42 weapon
43
44 toothed rail
45 attachment screw
46 closing plate
47 actuation slot (of 12)
48 mounting pocket
49 arrow direction
50 disc spring
51 bearing pocket
52 bearing hole (for 51)
53 key surface (of 12)
54 arrow direction (for 53)
55 arrow direction (for 50)
56 longitudinal groove (of 4)
57 attachment screw (for 3)
58 guide part
59 end projection (of 58)
60 guide recess
61 guide projection
62 bearing surface
63 displacement path
64 locking ball
65 compression spring
66 cross hole
67 elongated hole
68 distance (between 1 and 69)
69 weapon barrel
70 bearing surface
71 distance
72 release
73 clamp shaft hole
74 bolt end (of 12)
75 locking recess

The invention claimed is:

1. A mounting device for the detachable mounting of a telescopic sight on a weapon, comprising:

a base rail attachable to the weapon, and a mounting rail attachable to the telescoping sight, the mounting rail being connectable to the base rail by at least one locking element, wherein the locking element comprises a clamping shaft is held rotatably in a first one of the base rail and the mounting rail, wherein a second one of the base rail and the mounting rail comprises a stay bolt, the clamping shaft having at least one wedge recess which, during rotating actuation of the locking element, can be brought into force-fitted engagement with a recess of the stay bolt, the stay bolt being mounted in a guide part of the second one of the rails, in a spring-loaded manner, such that the stay bolt is displaceable in an axial direction of the stay bolt, the locking element being configured such that the rotating actuation of the locking element causes displacement of the stay bolt in the axial direction of the stay bolt, thereby generating at least one clamping force acting between the base rail and the mounting rail perpendicularly to the axial direction (longitudinal direction) of the base rail and the mounting rail, resulting in an interlocking and force-fitted connection between the base rail and the mounting rail, wherein the locking element, during clamping or locking between the base rail and the mounting rail, mounted interlocked thereon, additionally generates a displacement force acting in the axial direction (longitudinal direction) of the base rail and the mounting rail.

2. A mounting device for the detachable mounting of a telescopic sight on a weapon, comprising:

a base rail attachable to the weapon, and a mounting rail attachable to the telescoping sight, the mounting rail being connectable to the base rail by at least one locking element, wherein the locking element comprises a clamping shaft held rotatably in a first one of the base rail and the mounting rail, wherein a second one of the base rail and the mounting rail comprises a stay bolt, the clamping shaft having at least one wedge recess which, during rotating actuation of the locking element, can be brought into force-fitted engagement with a recess of the stay bolt, wherein the stay bolt is firmly attached on the second one of the rails and can be clamped or locked with the clamping shaft mounted in a spring-loaded manner on the first one of the rails, the locking element being configured such that the rotating actuation of the locking element causes displacement of the stay bolt in the axial direction of the stay bolt, thereby generating at least one clamping force acting between the base rail and the mounting rail perpendicularly to the axial direction (longitudinal direction) of the base rail and the mounting rail, resulting in an interlocking and force-fitted connection between the base rail and the mounting rail, wherein the locking element, during clamping or locking between the base rail and the mounting rail, mounted interlocked thereon, additionally generates a displacement force acting in the axial direction (longitudinal direction) of the base rail and the mounting rail.

3. The mounting device according to claim 1, wherein the stay bolt has a bolt end, having a profiled hollow recess.

4. The mounting device according to claim 3, wherein the profiled hollow recess is formed as a wedge-shaped profiled hollow recess extending in a transverse direction to a longitudinal extension of the bolt end.

5. The mounting device according to claim 3, wherein the hollow recess is formed as a portion of a circular solid profile of the stay bolt.

6. The mounting device according to claim 1, wherein the locking element cooperating with the stay bolt comprises a handle and a clamping shaft connected thereto with a wedge recess machined into the clamping shaft on one side of the clamping shaft.

7. The mounting device according to claim 1, wherein the clamping shaft is arranged in a clamping shaft hole in the first one of the rails, which clamping shaft hole is eccentric in relation to a center axis of a hollow recess of the stay bolt.

8. The mounting device according to claim 1, wherein the stay bolt comprises a head-like closing plate and a bolt end, the head-like closing plate having an enlarged diameter relative to the bolt end, the head-like closing plate being rotatably mounted in a bearing pocket of the second one of the rails during an initial state, and rotatably locked thereafter.

9. The mounting device according to claim 1, wherein the stay bolt is mounted in a spring-loaded, longitudinally displaceable manner in a sleeve-shaped, guide part of the second one of the rails, the sleeve-shaped, guide part being open on one side.

10. The mounting device according to claim 9, wherein the open side of the sleeve-like guide part faces opposite to a firing direction of the weapon.

11. The mounting device according to claim 1, wherein the second one of the rails comprises at least one disc spring which bears against an underside of a closing plate of the stay bolt to thereby spring-load the stay bolt.

12. The mounting device according to claim 11, wherein the disc spring is mounted in a bearing pocket of the second one of the rails to which a bearing hole adjoins in an axial direction of the stay bolt.

13. The mounting device according to claim 11, wherein, the second one of the rails further comprises a mounting pocket that is displaced relative to the bearing pocket in a longitudinal direction of the second one of the rails, the mounting pocket being separated from the bearing pocket by a shoulder, such that the disc spring is insertable through the mounting pocket into the bearing pocket during mounting of the disc spring in the bearing pocket.

14. The mounting device according to claim 1, wherein the stay bolt is secured against falling out of a bearing hole in the second one of the rails.

15. The mounting device according to claim 1, wherein the stay bolt is secured against rotation by a rotation lock.

16. The mounting device according to claim 14, wherein the stay bolt is secured against falling out of the bearing hole by a bayonet screw connection of the stay bolt in the bearing hole.

* * * * *